US005373305A

United States Patent [19]

Lepore, Jr. et al.

[11] Patent Number: 5,373,305

[45] Date of Patent: Dec. 13, 1994

[54] RF-TRANSPARENT ANTENNA SUNSHIELD MEMBRANE

[75] Inventors: Albert Lepore, Jr., Upper Holland, Pa.; Hamilton Wong, Pennington, N.J.; Susan L. Marr, Northampton Township, Bucks County; Leo J. Amore, Phoenixville, both of Pa.

[73] Assignee: Martin Marietta Corporation, East Windsor, N.J.

[21] Appl. No.: 51,510

[22] Filed: Apr. 22, 1993

Related U.S. Application Data

[63] Continuation-in-part of Ser. No. 885,577, May 19, 1992, abandoned.

[51] Int. Cl.[5] ..... H01Q 1/42; H01Q 1/28; H01Q 1/40

[52] U.S. Cl. ..... 343/872; 343/909; 343/DIG. 2

[58] Field of Search ..... 343/872, 873, 909, 911 R, 343/DIG. 2; H01Q 1/40, 1/92, 1/28

[56] References Cited

U.S. PATENT DOCUMENTS

| | | | |
|---|---|---|---|
| 3,396,400 | 8/1968 | Kelley et al. | 343/872 |
| 4,479,131 | 10/1984 | Rogers et al. | 343/872 |
| 4,666,760 | 5/1987 | Hasuda et al. | 428/215 |
| 4,741,778 | 5/1988 | Horie et al. | 106/287.16 |
| 5,273,815 | 12/1993 | Brydon et al. | 343/909 |

FOREIGN PATENT DOCUMENTS

| | | | |
|---|---|---|---|
| 0489531 | 6/1992 | European Pat. Off. | 343/872 |
| 0053702 | 10/1988 | Japan | 343/872 |
| 0119103 | 5/1989 | Japan . | |

OTHER PUBLICATIONS

"ITO-Coated RF Transparent Materials for Antenna Sunshields-Space Environment Effects," by C. Bowman et al., *IEEE Trans. on Nuclear Science*, vol. 37, No. 6, Dec. 1990, pp. 2134–2137.

"Usage of ITO to Prevent Spacecraft Charging," by R. D. Goldstein et al., *IEEE Trans. on Nuclear Science*, vol. NS-29, No. 6, Dec. 1982, pp. 1621–1628.

"A Thermally Opaque, Millimeter-Wave Radome for Space," by M. S. Powell et al., *1986 International Symposium Digest Antennas and Propagation*, vol. II, pp. 927–930.

"Combined Radiation Effects on Optical Reflectance of Thermal Control Coatings," by J. Marco et al., *4th Int'l. Conf. on Spacecraft Materials in Space Environment*, Sep. 6–9, 1988, pp. 121–132.

"Thermal Control Material & Metalized Films," Part No. Listing and General Specifications by Sheldahl Corporation, Northfield, Minn., Jul. 1989, pp. 1–10, 29 and 61.

PCT International Search Report for PCT/US93/04681 dated Aug. 24, 1993.

*Primary Examiner*—Rolf Hille
*Assistant Examiner*—Peter Toby Brown
*Attorney, Agent, or Firm*—Clement A. Berard, Jr.

[57] ABSTRACT

An RF-transparent sunshield membrane covers an antenna reflector such as a parabolic dish. The membrane includes at least two dielectric sheets of polyimide film 1 mil thick. The surface of the outer film facing away from the reflector is coated with an electrically semiconductive coating such as vapor-deposited germanium having a thickness in the range of 200 Å to 600 Å. A member, such as a glass fiber mat, may be located in the space between the two dielectric sheets for maintaining the sheets in spaced-apart relationship. In another embodiment of the invention, the surface of the film facing the reflector may be reinforced by an adhesively attached polyester or glass fiber mesh.

21 Claims, 3 Drawing Sheets

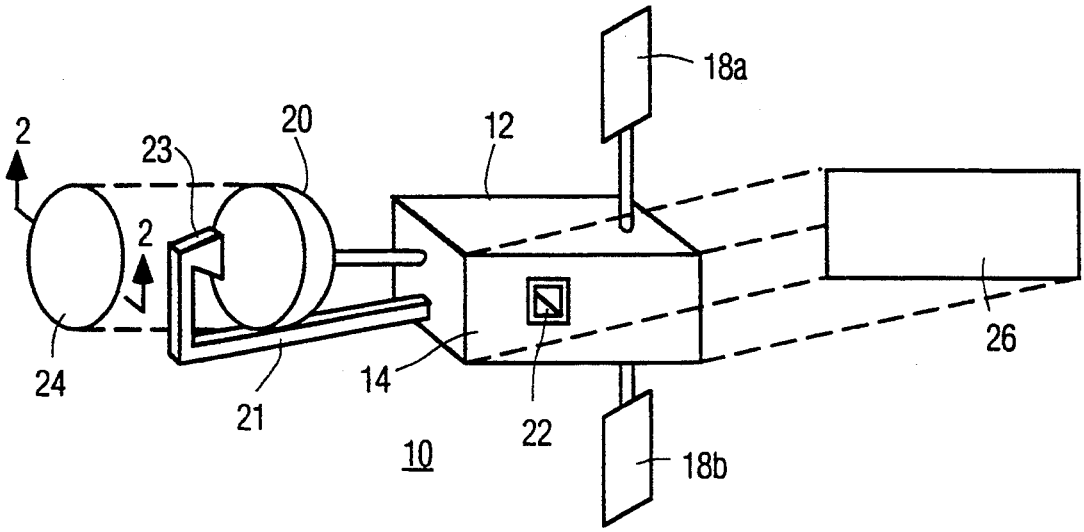
FIG. 1
FIG. 2
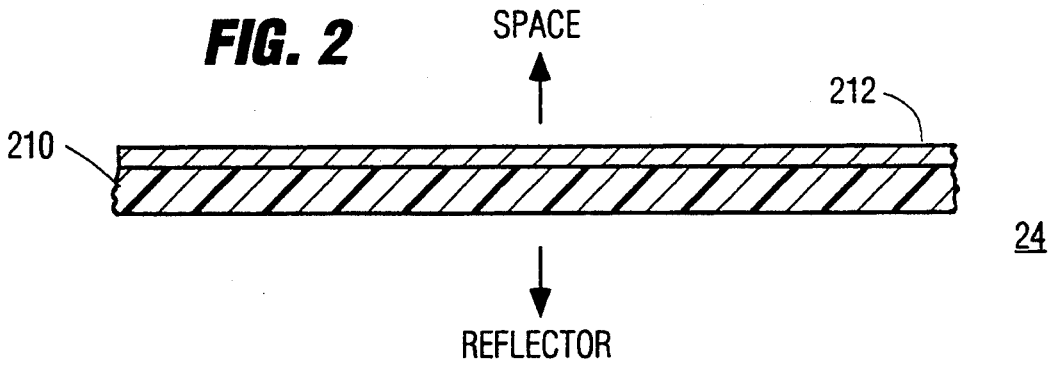

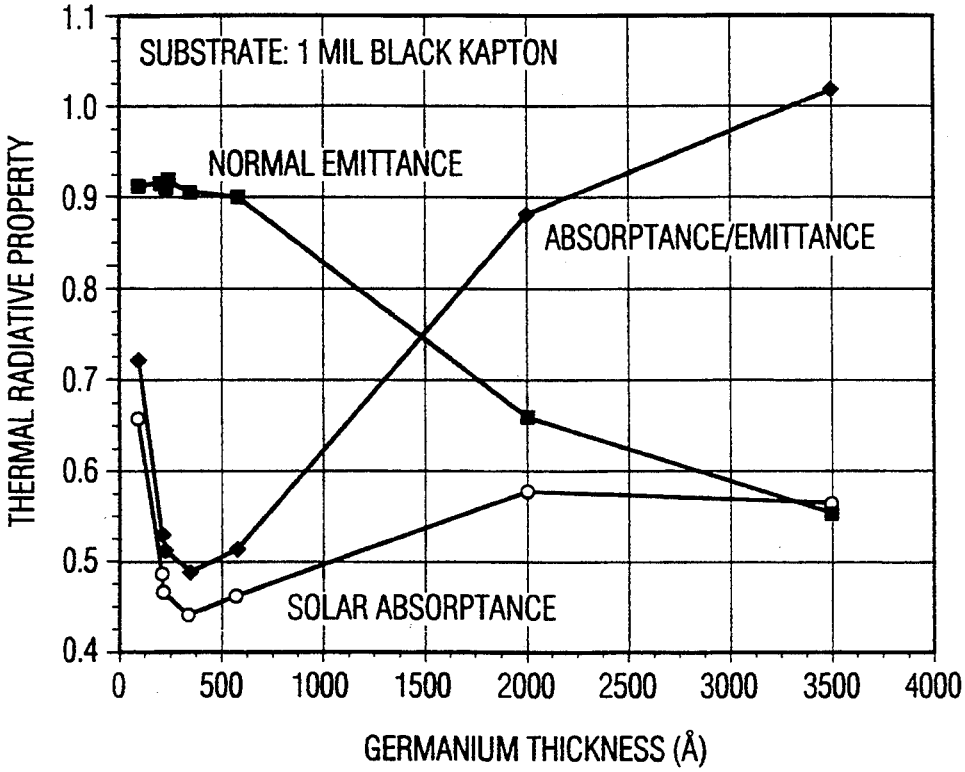
FIG. 3
FIG. 4
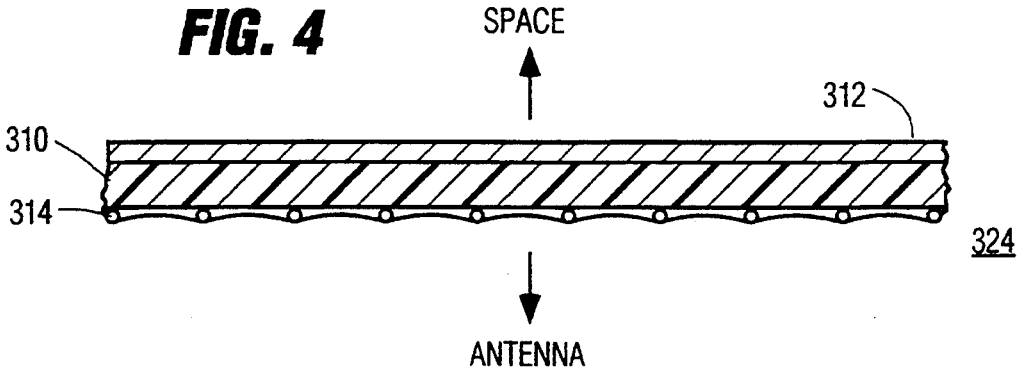

RF-TRANSPARENT ANTENNA SUNSHIELD MEMBRANE

This application is a continuation-in-part of copending application Ser. No. 07/885,577, filed May 19, 1992, now abandoned.

This invention relates to electrically conductive thermal membranes or blankets for protection of a structure against thermal effects from sources of radiation such as the sun.

One such structure is an antenna including a parabolic or shaped reflector. If pointed at a source of radiation such as the sun, the reflector will focus the energy from the sun onto the antenna's feed structure, possibly destroying the feed. Also, the reflector may be heated in such a manner that mechanical distortion or warping occurs, which may adversely affect proper operation.

In addition, when the antenna is mounted on a satellite as illustrated in FIG. 1, a fluence of charged particles may cause electrostatic potentials across portions of the antenna made from dielectric materials. If the potentials are sufficiently large, electrostatic discharges (ESD) may occur, resulting in damage to sensitive equipments.

A sunshield adapted for use across the aperture of a reflector antenna should significantly attenuate passage of infrared, visible and ultraviolet (UV) components of sunlight to the reflector, should have a conductive outer surface to dissipate electrical charge buildup which might result in electrostatic discharge (ESD), and should be transparent to radio-frequency signals (RF), which for this purpose includes signals in the range between the UHF band (30 to 300 MHz) and Ku band (26 to 40 GHz), inclusive.

Prior art multilayer sunshields which include plural layers of aluminized polyimide film such as KAPTON® film or MYLAR® film cannot be used, because they are opaque to RF at the above-mentioned frequencies. A multilayer blanket may be disadvantageous because absorbed heat can become trapped among the several layers. The temperature of the layers rises, and they produce infrared radiation which can impinge on the reflector, thereby causing the reflector to overheat.

U.S. Pat. No. 4,479,131, issued Oct. 23, 1984 to Rogers et al., describes a thermal protective shield for a reflector using a layer of germanium semiconductor on the outer surface of a sheet of KAPTON® film, with a partially aluminized inner surface, arranged in a grid pattern which is a compromise between RF transmittance and solar transmittance. To the extent that this arrangement allows solar transmittance, the shield and/or the reflector may heat. Such heating may not be controllable because the reflectivity of the aluminized sheet may reflect infrared radiation from the reflector back toward the reflector, and also because both the germanium and aluminization have low emissivity.

In particular, the Rogers et al. reflector shield disadvantageously requires a costly process to apply the aluminization to its inner surface, at a thickness of 1500±400 Å, and then to etch away the aluminum in a grid pattern, allowing gaps of exactly the right width to achieve the desired RF transparency (column 3, lines 31–48). Rogers et al. require a thick germanium optical coating on the outer (space-facing) surface at a critical thickness of 1600 Å±20%. If the germanium were too thick the front surface emittance would be too low; if it were too thin the solar transmittance would increase (column 4, lines 18–34). Thus, Rogers et al. teach that the thickness of the front-surface germanium coating must be greater than about 1280 Å for operability of their sunshield.

Another RF-transparent prior art sunshield has one layer of structure including a two-mil (0.002 inch) black KAPTON® film, reinforced with adhesively-affixed DACRON® polyester mesh on the side facing the reflector, and with the space-facing side painted to a thickness of about four mils with a white polyurethane paint such as Chemglaze Z202. The surface of the paint is vapor coated with an electrically conductive layer such as 75±25 Å of indium-tin oxide (ITO). Such a sunshield, immediately after manufacture, has solar absorptivity $\alpha$, averaged over the visible spectrum, between 2.5 and 25 microns, of about 0.3, an emissivity ($\epsilon$) of about 0.8, and a surface resistivity in the range about $10^6$ to $10^8$ ohms per square (ohms/□ or Ω/□). It has two-way RF insertion loss of about 0.24 dB.

It has been discovered that exposure of the above-described single-layer sunshield to a fluence of charged particles and solar ultraviolet radiation causes a gradual degradation. The on-orbit data, together with laboratory simulation data, suggest that in the course of a 10-year mission, $\alpha$ increases from about 0.3 to about 0.85, and surface resistivity increases to about $10^{10}$ ohms per square. Such an increase in absorptivity may cause the single-layer sunscreen to produce sufficient infrared radiation from its surface that faces the antenna reflector, thereby to cause the antenna reflector to overheat. The increase in surface resistivity may result in ESD. New generations of satellites are intended to have mission durations much exceeding ten years, so the prior art sunscreen cannot be used. An improved sunscreen is desired.

A sunscreen according to the invention comprises at least two RF-transparent dielectric films, a first one of which is coated on the space-facing side with a semiconductor layer having a thickness between about 150 Å to 900 Å. The semiconductor may be germanium. In a particular embodiment, the dielectric films are a pigmented polyimide film or a pigmented polyetherimide film between about ½–3 mils (0.0005–0.003 inch) thick, which absorbs ultraviolet and visible light. In a further embodiment of the invention, the two dielectric films are spaced apart by a spacing member.

IN THE DRAWING

FIG. 1 is a perspective or isometric view of a reflector antenna mounted on a spacecraft, with a sunscreen illustrated as being exploded away from the reflector to show details;

FIGS. 2 and 4 are cross-sectional views of an outer layer of the sunscreen according to the invention which may be used as the sunscreen in FIG. 1;

FIG. 3 is a graph of the thermal radiative properties of an outer layer of the sunscreen according to the invention.

Figure 5:
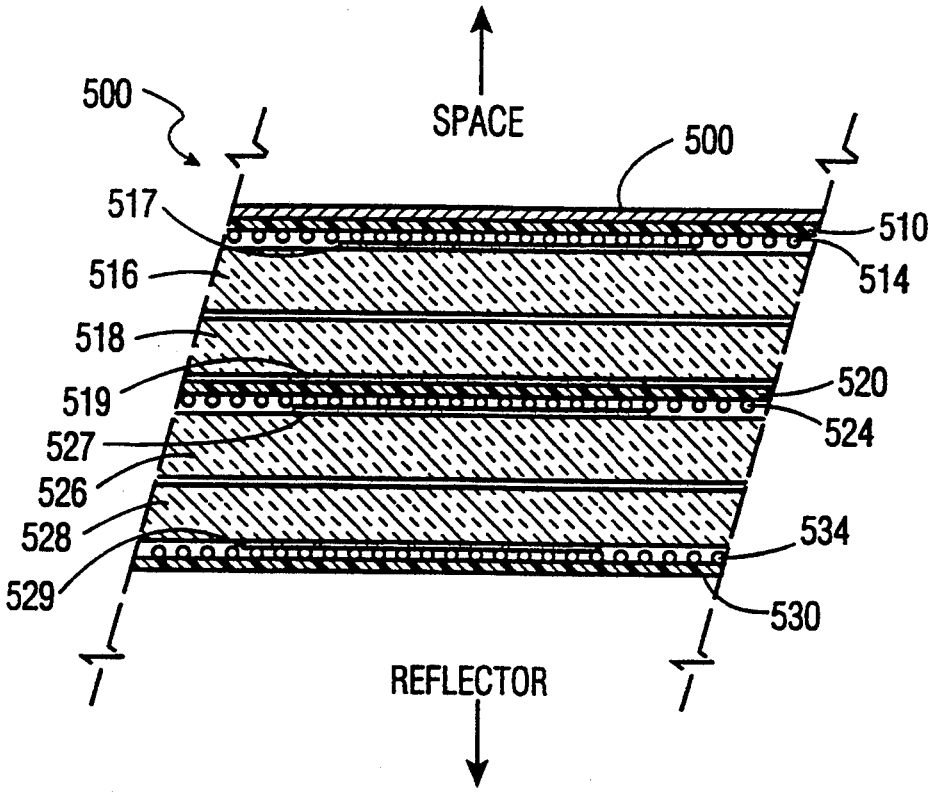
FIGS. 5 and 6 are cross-sectional views of a multiple-layered sunscreen according to the present invention.

In FIG. 1, a spacecraft designated generally as 10 includes a body 12 having a wall 14. First and second solar panels **18*a* and 18*b*, respectively, are supported by body 12. A reflector antenna 20 including a feed cable 21 provides communications for satellite 10. Feed cable 21 terminates in a reflector feed 23 at the focal point of reflector 20**.

As mentioned above, if reflector 20 is directed toward a source of radiation such as the sun, the radiation may be absorbed by the structure of the reflector, raising its temperature and possibly warping or destroying its structure. Even if the reflector is not affected, it may concentrate energy on, and destroy, feed 23.

A known scheme for reducing the problems described above is to cover the open radiating aperture of reflector 20 with a sunscreen or thermal barrier membrane (blanket), illustrated as sheet 24 in FIG. 1, exploded away from reflector 20. Sunscreen 24 may be attached to the rim of reflector 20 by means (not illustrated) such as adhesive, or it may be held by fasteners, such as VELCRO® tape.

An ideal antenna sunshield membrane for use on communication spacecraft would exhibit all of the following characteristics:

(1) Low RF loss
(2) Low solar absorpance ($\alpha$)
(3) High IR (infrared) emittance ($\epsilon$)
(4) Low transmittance ($\tau$) of visible and infrared
(5) High tear strength
(6) Long term space stability—Resistance to degradation caused by solar ultraviolet and ionizing radiation, thermal cycling, atomic oxygen
(7) Sufficient electrical conductivity for ESD protection (i.e. surface resistivity $R_s$ in the range $10^6$–$10^9\Omega/\square$).

The present invention is an improved membrane configuration which has been developed to largely satisfy these criteria. The sunshield of FIG. 2 comprises a thin outer layer 212 of germanium (~200–600 Å) vacuum-deposited onto a pigmented flexible film 210, of about 0.0005 to 0.003 inch in thickness. As installed on a spacecraft, the germanium-coated surface of film 210 is the space-facing side, while the uncoated surface of film 210 is the antenna reflector-facing side as shown in FIG. 2.

The germanium film is applied by conventional vacuum deposition as is available, for example, from Sheldahl Company, located in Northfield, Minn. 55057 and from Courtaulds Performance Films, located in Canoga Park, Calif. 91304.

The germanium component of the germanium-coated pigmented-film membrane significantly decreases the absorptance over that of the pigmented film substrate alone. Concurrently, a thin germanium film (i.e. <900 Å thick) due to its inherent high IR transmittance does not greatly interfere with the inherent high emittance property of the pigmented substrate. Thus, a thermal control membrane with low solar absorptance and high IR emittance can be achieved by controlling the germanium coating thickness as is described henceforth.

Note that the high transmissivity of the germanium coating does not change the net or combined transmissivity $\tau$ of the membrane taken as a whole. This combined transmissivity is still virtually zero because the transmittance of the black-pigmented polyimide substrate is virtually zero ($\tau \approx 0.0$). Low transmittance is desired because any solar energy that passes through the sunshield membrane will impinge on the antenna causing its temperature to increase, which tends to cause undesirable thermally-induced deformation.

FIG. 3 is a graph of the thermal radiative properties of a germanium-coated black-pigmented polyimide substrate as a function of the thickness of the germanium coating. As shown in FIG. 3, a very thin germanium coating of less than about 150 Å thickness yields a solar absorptance $\alpha > 0.60$ and an emittance $\epsilon > 0.90$. Although the desired high emittance is attained, the solar absorptance is very high, indicating the germanium film may be too thin. For relatively thick germanium coating, e.g., greater than about 900 Å, the emittance becomes undesirably low and solar absorptance becomes undesirably high. At germanium coating thicknesses between 150 Å and 900 Å, however, the solar absorptance drops significantly (<0.5), while the emittance is still maintained relatively high (>0.80). Thermal radiative properties for three germanium coated black polyimide membranes with coating thicknesses within this region are presented in Table 1 below:

TABLE 1

| | Germanium Coatings on Black Polyimide Membranes | | |
|---|---|---|---|
| Ge Thickness | 225 Å | 355 Å | 600 Å |
| $\alpha$ (solar absorptance) | 0.48 | 0.44 | 0.46 |
| $\epsilon$ (IR emittance) | 0.92 | 0.91 | 0.89 |
| $\tau$ (transmittance) | 0.00 | 0.00 | 0.00 |

The ratio of absorptance to emittance ($\alpha/\epsilon$) is the most frequently used parameter for evaluating the thermo-optical characteristics of a thermal control surface, such as a sunshield membrane. Such membranes should have an $\alpha/\epsilon$ ratio of less than about 0.6; most have values in the range of 0.5 to 0.6 As shown in FIG. 3, the $\alpha/\epsilon$ ratio falls below about 0.6, into the range suitable for antenna sunshield membrane applications, when the thickness of the germanium coating is between about 150 Å and about 900 Å. At germanium thicknesses below or above the optimum thickness range of 150–900 Å, the $\alpha/\epsilon$ ratio is higher than desired (>0.6) for application to spacecraft antenna reflector sunshield membranes. The preferred range of germanium thickness for lower $\alpha/\epsilon$ ratio is between about 200 Å and 600 Å, for example, $\alpha/\epsilon \lesssim 0.52$. As used herein with respect to the thickness of the layer of semiconductive material, "about" would include variations of thickness which produce the desirable characteristics described above, in particular, with respect to FIG. 3. As such, "about" would include tolerances associated with the deposition of such layer and with the measurement of its thickness.

The foregoing describes the optimization of germanium coating thicknesses applied to one type of polyimide substrate, black-pigmented polyimide, which results in a thermal control membrane with a low solar absorptance, a high IR emittance, a low RF insertion loss and low transmittance. Similar results may be obtained by using a white or black-pigmented polyetherimide substrate; however, the black polyimide or black polyetherimide is preferred because their transmittance $\tau$ is substantially zero, thereby minimizing transmission of solar energy through the membrane to the reflector. White-pigmented polyetherimide exhibits transmittance of $\tau = 0.32$.

Materials suitable for the membranes of the present invention include KAPTON® polyimide, available from E. I. dupont de Nemours Company, located in Wilmington, Del. 19898, which can be loaded with pigment to produce colored film, such as carbon powder to provide a black film. Black polyimide is a preferred substrate material in that it minimizes transmittance $\tau$ and RF transmission loss through the membrane.

An alternative material is flexible GE ULTEM® film having a thickness of about 0.0005 to 0.003 inch.

ULTEM ® material is a form of polyetherimide, available from GE Plastics, located in Pittsfield, Mass. 01201, which can be loaded with pigment to produce pigmented (colored) film. White ULTEM ® material is a titanium dioxide ($TiO_2$) pigment-loaded form of polyetherimide; black ULTEM ® material is pigmented with carbon powder. Polyetherimide, a high-temperature thermoplastic, can be solution-cast into film 0.0005 inch to 0.020 inch in thickness. It may be bonded to dissimilar materials by a variety of adhesive systems including polyurethanes, silicones, and epoxies (non-amine). It also can be bonded to itself through solvent bonding, using methylene chloride or trichloroethylene or through ultrasonic bonding, as is known to those skilled in the art. Polyetherimide film is stable when exposed to UV radiation and has a tear strength of about 22 g/mil.

Uncoated polyimide and polyetherimide both exhibit low RF insertion losses (<0.02 dB over the 2.5 and 15 GHz frequency range). A germanium coating of up to about 2000 Å on a black polyimide membrane also exhibits a low RF insertion loss (<0.05 dB) over the same frequency range. Thinner germanium coatings will exhibit even lower RF insertion losses; however, these losses are too low to be of concern. This data confirms that polyimide and polyetherimide membranes with coatings of germanium of a wide range of thicknesses are highly RF transparent and are therefore suitable for antenna sunshields. In addition, the surface resistivity of a 200 Å to 600 Å-thick germanium coating is sufficiently low ($R_s = 10^6$–$10^9 \Omega/\square$) to minimize electrostatic charging effects.

The present invention has considerable advantage over prior art sunshield membranes because it exhibits the desirable characteristics set forth above; in particular, lower RF insertion loss. Table 2 sets forth the average RF insertion loss of prior art sunshields and of the present invention in the frequency range of 2.5–15 GHz.

TABLE 2

| RF Insertion Loss | |
|---|---|
| Membrane Types | RF Insertion Loss |
| Prior Art: | |
| ITO-coated white paint on black KAPTON ® film | 0.3–0.2 dB |
| ITO-coated clear KAPTON ® film with white paint on the second surface | 0.2 dB |
| Thick germanium coating on clear KAPTON ® film with aluminum grids on the second surface (U.S. Pat. No. 4,479,131) | 0.2 dB |
| Present Invention: | |
| Optimized germanium coating on black KAPTON ® film | <0.05 dB |

The reason for the lower RF insertion loss of the present invention as compared to U.S. Pat. No. 4,479,131, is that the latter relies on a second surface aluminum grid to achieve desirable thermo-optical properties. These aluminum grids produce a correspondingly higher RF insertion loss. On the other hand, the current invention utilizes a thin coating of germanium to control the thermo-optical properties (i.e. both decreasing solar absorptance and maintaining emittance) without undesirably increasing RF insertion loss.

An important characteristic of a thermal control membrane or blanket is its resistance to electrostatic charge build up which leads to potentially damaging or disruptive electrostatic discharge (ESD). Germanium coatings about 150 Å to 900 Å thick have a surface resistivity $R_s$ in the range of $10^6$ to $10^9$ ohms/□ which is well suited to avoiding ESD. A maximum charge-induced potential of 1000 V or less is a suitable design goal value. Samples of such membranes having various thicknesses of germanium coating on a 1-mil-thick black polyimide film were subjected to a fluence of 20-KeV electrons, over a temperature range of about +80° to −170° C. The results set forth in Table 3 below correspond to a worst-case condition, which is at the lowest temperature in the range, that is, the temperature where the surface resistivity $R_s$ of the germanium is greatest.

TABLE 3

| Electrostatic Charging Potential | |
|---|---|
| Ge Thickness | Potential at −170° C. |
| 225 Å | 1750 V |
| 365 Å | 1200 V |
| 600 Å | ≦1000 V |

The temperature range of +80° C. to −170° C. is typical for an appendage to a spacecraft, such as an antenna reflector or a solar array; however, body mounted members experience a much more benign range. Accordingly, a sunshield membrane with about a 600-Å-thick germanium coating is well suited for an antenna reflector sunshield membrane whereas membranes with thinner coatings are suitable for utilization in close proximity to the spacecraft body, such as sunscreen 26 of FIG. 1. As can be seen from FIG. 3, the lowest $\alpha/\epsilon$ ratio occurs at about 400 Å, which is therefore the preferred thickness where extreme cold temperature is not encountered.

FIG. 4 illustrates a cross-section of a sunscreen 324 according to the invention, which may be used as sunscreen or membrane 24 of FIG. 1. The single structure of FIG. 4 includes a sheet 310 of pigmented polyimide film about 1 mil (0.001 inch) thick. A suitable material is KAPTON ® film, manufactured by E. I. dupont de Nemours Company. A reinforcing web 314 of Style E1070 glass fiber mesh is affixed to the reflector-facing side of polyimide sheet 310 by, for example, a her-melt moisture-cure polyurethane adhesive (not separately illustrated). A coating 312 of germanium is deposited on the space-facing side of polyimide sheet 310. Satisfactory performance is achieved by a coating with a thickness in the range of about 200 to 600 Å, applied by vapor deposition, as described above. Such germanium coatings have a surface resistivity $R_s$ in the range of $10^6$ to $10^9$ ohms per square. Alternatively, reinforcing web 314 could employ a mesh of other materials, such as a DACRON ® polyester fiber or other fiber.

A sunscreen according to the invention was tested by exposure to a simulated space environment. The tests included exposure to ultraviolet light for about 10,600 equivalent sun hours (ESH), 2727 thermal cycles from −70° C. to +120° C., and a combined effects exposure of an electron fluence of $5 \times 10^{15}$ #/cm$^2$, a proton fluence of $7 \times 10^{14}$ #/cm$^2$, and 1000 ESH LrV light. The 10,600 ESH UV test is equivalent to about 3.8 years in orbit. The tests showed a negligible change of $\alpha$ from 0.461 to 0.465 for the sample having a 600-Å-thick germanium coating, which difference is within the accuracy of the measurements. The emissivity ($\epsilon$) changed from 0.89 to 0.90, and the surface resistivity remained within the $10^6$ to $10^9$ ohms per square range.

The present invention may also be employed in a multiple-membrane layered arrangement 500 of the sort shown in FIG. 5. A first black pigmented polyimide dielectric film membrane 510 has about a 600-Å-thick layer 512 of vacuum deposited germanium on its space-facing surface and a Style E1070 glass fiber reinforcement mesh 514 bonded to its reflector-facing surface. A second, intermediate, black pigmented polyimide film 520 has fiberglass-reinforcing mesh 524 bonded to its reflector-facing surface and a third, inner, black polyimide film 530 has such reinforcing mesh 534 bonded to its space-facing surface. Suitable glass fiber mesh is available from National Metallizing Division, STD Packaging Corporation, located in Cranbury, N.J. 08521. Dielectric films 510, 520 and 530 are each 0.001 inch thick; only film 510 has a germanium coating layer.

Quartz fiber mats 516 and 526, which are about 0.2 inch thick, are adhesively bonded to the reflector-facing surfaces of polyimide films 510 and 520, respectively, to increase the thermal isolation across the multilayer membrane blanket 500. Similarly, quartz fiber mats 518 and 528 are likewise bonded to the space-facing surfaces of polyimide films 520 and 530. Areas of adhesive, 517, 519 and 527, 529, respectively, secure mats 516, 518 and 526, 528, to films 510, 520, and 530. The quartz fiber mats 516, 518, 526, 528 provide increased radiation isolation by creating a complex, multiple re-radiation heat transfer path between the polyimide films 510, 520, 530. Heat transfer from film to film occurs by radiation to individual fibers of the mats which must then re-radiate to adjacent fibers. This must occur many times for heat to reach the opposite polyimide film, e.g., from film 510 to film 520. Conduction heat transfer is limited by the low thermal conductivity, narrow cross-section, and length of the individual glass fibers of mats 516, 518, 526, 528. Suitable quartz fiber mats are available under the tradename ASTROQUARTZ from J. P. Stevens Company, located in New York, N.Y. 10036.

Figure 6:
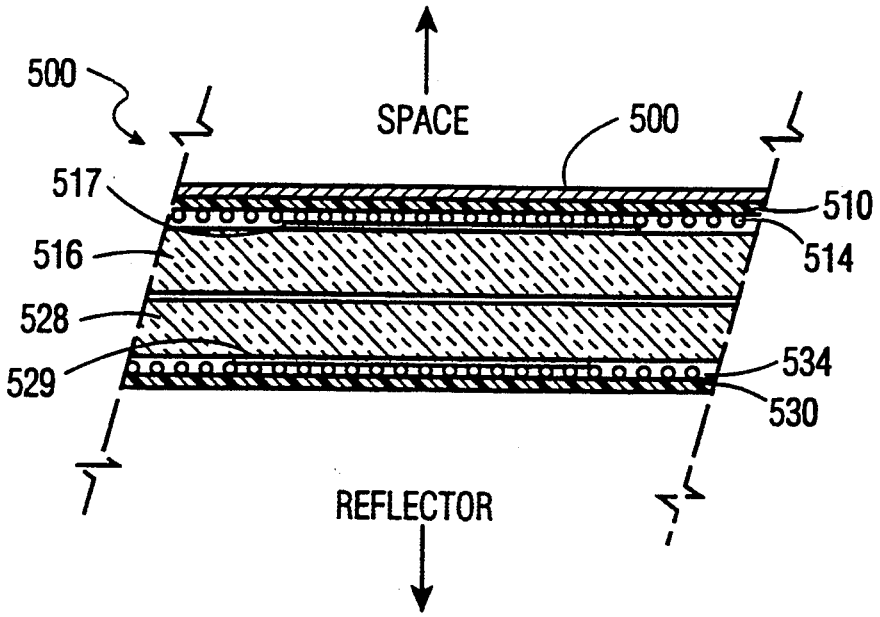

FIG. 6 shows an alternative embodiment of a multiple membrane layered arrangement which employs only two dielectric film layers. Elements of membrane 500' shown in FIG. 6 that are the same as those of membrane 500 of FIG. 5 bear the same numerical designations. Membrane 500' is the same as membrane 500 except that second film 520, reinforcing mesh 530 and quartz fiber mats 518 and 526 have been removed. Membrane 500' is advantageous where a lighter weight membrane is desired and the slightly reduced thermal insulation characteristic thereof is suitable.

In an application for a 2.5-meter-diameter spacecraft antenna reflector operating in the 12–14 GHz frequency band, the multilayer membrane of FIG. 5 or FIG. 6 is held together by stitching around its periphery with two stitch lines on its face. Suitable thread is available from Eddington Thread Manufacturing Company, located in Eddington, Pa. 19020. The volume between the layers is vented to space via a plurality of venting ports around its periphery. An electrically conductive path from the germanium layer 512 on dielectric film 510 is provided via a plurality of electrically conductive adhesive aluminum tapes and electrically conductive VELCRO® fasteners (available from Velcro USA Corporation, located in Manchester, N.H. 03108) and then by grounding wire to the spacecraft structure.

Other embodiments of the invention will be apparent to those skilled in the art. For example, while the sunscreen has been described as a cover for a reflector antenna, it may be applied as a blanket around or over any structure or apparatus, such as a portion of the spacecraft, for example, sunscreen 26 of FIG. 1 which is illustrated as exploded away from wall or face 14 of spacecraft body 12. As illustrated in FIG. 1, an antenna 22 is flush-mounted in wall 14, and may radiate through sunscreen 26 when in place. Also, the reflector feed may be within the reflector, so that the feed is also protected against thermal effects by a membrane according to the invention placed over the mouth or opening of the reflector, or across the mouth or opening of the reflector feed itself, or both.

In addition, where a lower surface resistivity of the germanium coating is desired, such as for very low temperature conditions, dopants, such as boron, aluminum, phosphorus, arsenic or other elements of the III or V groups, may be added to the germanium, as is known to those skilled in the art.

Further, although the embodiments described herein employ a germanium semiconductor layer, in part because in its intrinsic form it exhibits greater conductivity than does silicon, other semiconductor materials such as silicon, or gallium arsenide could be employed.

What is claimed is:

1. A thermally insulating membrane comprising:

at least two sheets of dielectric film located between said structure and space including an inner sheet proximate said structure and an outer sheet facing space, each of said sheets having inner and outer surfaces facing said structure and facing space, respectively, at least said outer dielectric film including a pigment added thereto for absorbing radiation in the infrared and visible light portions of the spectrum;

means for maintaining said two sheets of dielectric film in spaced-apart relationship; and a layer of semiconductor material affixed to the outer surface of the outer one of said sheets of dielectric film, said layer having a thickness between about 150 Å and about 900 Å.

2. A membrane according to claim 1 wherein said layer of semiconductor material comprises a vacuum-deposited layer of germanium.

3. A membrane according to claim 2 wherein said layer of germanium has a thickness between about 200 Å and about 600 Å.

4. A membrane according to claim 3 wherein said layer of germanium has a thickness of about 600 Å.

5. A membrane according to claim 4 wherein said dielectric film is one of a polyimide film and a polyetherimide film.

6. A membrane according to claim 1 wherein said means for maintaining comprises a member located between said outer sheet and said inner sheet for maintaining said sheets in said spaced-apart relationship.

7. A membrane according to claim 6 wherein said member is a glass fiber mat.

8. A membrane according to claim 1 wherein said sheets of dielectric film are one of a polyimide film and a polyetherimide film.

9. A membrane according to claim 8 wherein said sheets of dielectric film have a thickness between about 0.0005 inch and about 0.003 inch.

10. A membrane according to claim 8 wherein said pigment is one of carbon and titanium dioxide.

11. A membrane according to claim 1 wherein said layer of semiconductor material has a thickness between about 200 Å and about 600 Å.

12. A membrane according to claim 11 wherein said thickness is about 600 Å.

13. A membrane according to claim 11 wherein said thickness is about 400 Å.

14. A membrane according to claim 1, further comprising a reinforcing mesh affixed to said inner surface of each of said sheets of dielectric film.

15. A membrane according to claim 14 wherein said reinforcing mesh is one of a polyester fiber mesh and a glass fiber mesh.

16. An antenna, comprising:

feed means;

reflection means coupled to said feed means for transducing signals between said feed means and space;

at least two sheets of dielectric film located between said reflection means and space including an inner sheet proximate said reflection means and an outer sheet facing space, each of said sheets having an inner surface facing said reflection means, and an outer surface facing space, said dielectric film of at least said outer sheet including a pigment added thereto for absorbing infrared and visible light;

means for maintaining said two sheets of dielectric film in spaced-apart relationship; and a layer of semiconductor material affixed to the outer surface of said outer sheet of dielectric film, said layer having a thickness between about 200 Å and about 600 Å.

17. A membrane according to claim 16 wherein said means for maintaining comprises a member located between said outer sheet and said inner sheet for maintaining said sheets in said spaced-apart relationship.

18. A membrane according to claim 17 wherein said member is a glass fiber mat.

19. A membrane according to claim 16 wherein said layer of semiconductor material comprises a vacuum-deposited layer of germanium.

20. A membrane according to claim 16 wherein said dielectric film is one of a polyimide film and a polyetherimide film.

21. A membrane according to claim 20 wherein each of said sheets of dielectric film has a thickness between about 0.0005 inch and 0.002 inch.

* * * * *